US007284673B2

(12) United States Patent
Habeger et al.

(10) Patent No.: US 7,284,673 B2
(45) Date of Patent: Oct. 23, 2007

(54) LOCKING STRUCTURE FOR HINGED CONTAINER

(75) Inventors: Hollis James Habeger, Crete, IL (US); Gregory L. Nelson, Mendota Heights, MN (US); Richard Thomas Steichen, Elk River, MN (US)

(73) Assignee: Reynolds Food Packaging LLC, Richmond, VA (US)

( * ) Notice: Subject to any disclaimer, the term of this patent is extended or adjusted under 35 U.S.C. 154(b) by 330 days.

(21) Appl. No.: 10/966,726

(22) Filed: Oct. 14, 2004

(65) Prior Publication Data

US 2006/0081641 A1 Apr. 20, 2006

(51) Int. Cl.
*B65D 6/00* (2006.01)

(52) U.S. Cl. ..... 220/4.23; 220/4.22; 220/839; 220/833; 220/835

(58) Field of Classification Search ..... 220/62.22, 220/62.13, 4.23, 4.22, 833, 834–835, 839
See application file for complete search history.

(56) References Cited

U.S. PATENT DOCUMENTS

| | | | | |
|---|---|---|---|---|
| 3,149,747 A | | 9/1964 | Burgess | 220/60 |
| 3,511,433 A | * | 5/1970 | Andrews et al. | 220/4.23 |
| 3,565,146 A | | 2/1971 | Arnolds | 150/0.5 |
| 3,786,982 A | * | 1/1974 | Rakes et al. | 229/406 |
| 4,576,330 A | * | 3/1986 | Schepp | 220/315 |
| 5,046,659 A | * | 9/1991 | Warburton | 220/4.22 |
| 5,169,014 A | * | 12/1992 | Hexamer | 220/4.22 |
| 5,515,993 A | * | 5/1996 | McManus | 220/4.23 |
| 6,644,494 B2 | | 11/2003 | Hayes et al. | 220/839 |
| 2004/0031795 A1 | * | 2/2004 | Galland et al. | 220/4.21 |
| 2005/0247709 A1 | * | 11/2005 | Atkins et al. | 220/4.23 |

FOREIGN PATENT DOCUMENTS

| | | |
|---|---|---|
| GB | 1 602 694 | 11/1981 |
| GB | 2 118 142 A | 10/1983 |

* cited by examiner

*Primary Examiner*—Anthony Stashick
*Assistant Examiner*—Christopher McKinley
(74) *Attorney, Agent, or Firm*—Greenberg Traurig, LLP; Paul F. McQuade; James Goepel

(57) ABSTRACT

Locking structure for thermoformed plastic containers for food and other articles wherein the lid and the base of the containers are provided with locking means, specifically a detent and a tab. The detent, which depends from the front of the lid, has rounded ends and an inwardly extending lip disposed on its outer side. The tab, which depends from the front of the base, has an upper surface, a lower surface, and two end surfaces. The upper surface is angled toward the lower surface and the end surfaces are substantially flat. The upper surface and the inwardly extending lip are constructed and arranged with respect to each other so that when the detent is pressed into the tab the inwardly extending lip will snap into position beneath the upper surface and interlock with it to lock the lid and base.

13 Claims, 3 Drawing Sheets

LOCKING STRUCTURE FOR HINGED CONTAINER

FIELD OF THE INVENTION

The present invention relates to thermoformed plastic hinged containers for food or other articles and, more specifically, a locking structure for holding the lid and base of such a container in closed condition.

BACKGROUND OF THE INVENTION

Containers for food or other articles thermoformed from plastic material normally comprise a lid and base that may be hinged to each other or may be separate parts. In order to hold the lid and base of the container in closed condition, it is necessary that the lid and base have a locking structure that can be manually opened and closed with relative ease. However, the structure should be capable of locking the container in closed condition to avoid accidental opening.

Various types of locking structures have been proposed in the past. For example, cylindrical male and female locking elements have been proposed as disclosed in British Patent Specification 2,118,142. Elongated rib structures comprising cooperating male and female elements have been proposed as disclosed in Canadian Patent 1,117,491 and U.S. Pat. No. 5,046,659. In the prior elongated rib structure locking elements, the locking action has taken place on the long sides or the ends of the ribs. This requires that the ribs be located in such a position on the container that both sides or ends of the ribs are engageable by the cooperating male and female elements to provide the locking action.

It would be desirable to provide a locking structure with male and female locking elements where the elements contain hook structures that interlock with respect to each other when the container is in a closed condition. This would improve the strength of the locking structure and allow hand closure of it while still holding significant weight.

The primary object of the present invention is to provide a locking structure for a container that provides a tighter lock between the container lid and base.

Another object of the invention is to provide a locking structure for a container that is easy to operate in opening and closing the locking structure on the container.

SUMMARY OF THE INVENTION

In accordance with the present invention there is provided a container for food or other articles comprising a lid having a horizontal flange extending around the periphery thereof and a base having a horizontal flange extending around the periphery thereof adapted for engagement with the horizontal flange of the lid when the container is in closed condition. A locking structure is provided wherein the locking structure has male and female locking elements containing hook structures that interlock with respect to each other when the container is in a closed condition. The hook structures include at least one detent depending from the front of the lid, the detent having an inwardly extending lip disposed on its outer side and rounded ends, and at least one tab that is located in the front of the base and dimensioned to receive a cooperating detent in the lid. The tab has an upper surface that is angled toward a lower surface and two substantially flat end surfaces. The inwardly extending lip of the detent and the upper surface of the tab are constructed and arranged to deflect with respect to each other so that when the detent is pressed into the tab, the inwardly extending lip snaps into position beneath the upper surface and interlocks therewith to lock the lid securely to the base.

The lid is hinged to the rear of the base for movement towards and away from the base for opening and closing the container and the locking means is located at the front of the base. In addition, the lid includes a central dome structure extending upwardly from the horizontal flange extending around the periphery thereof and the base includes a central receptacle structure depending from the horizontal flange extending around the periphery thereof.

DETAILED DESCRIPTION OF PREFERRED EMBODIMENT

Figure 1:
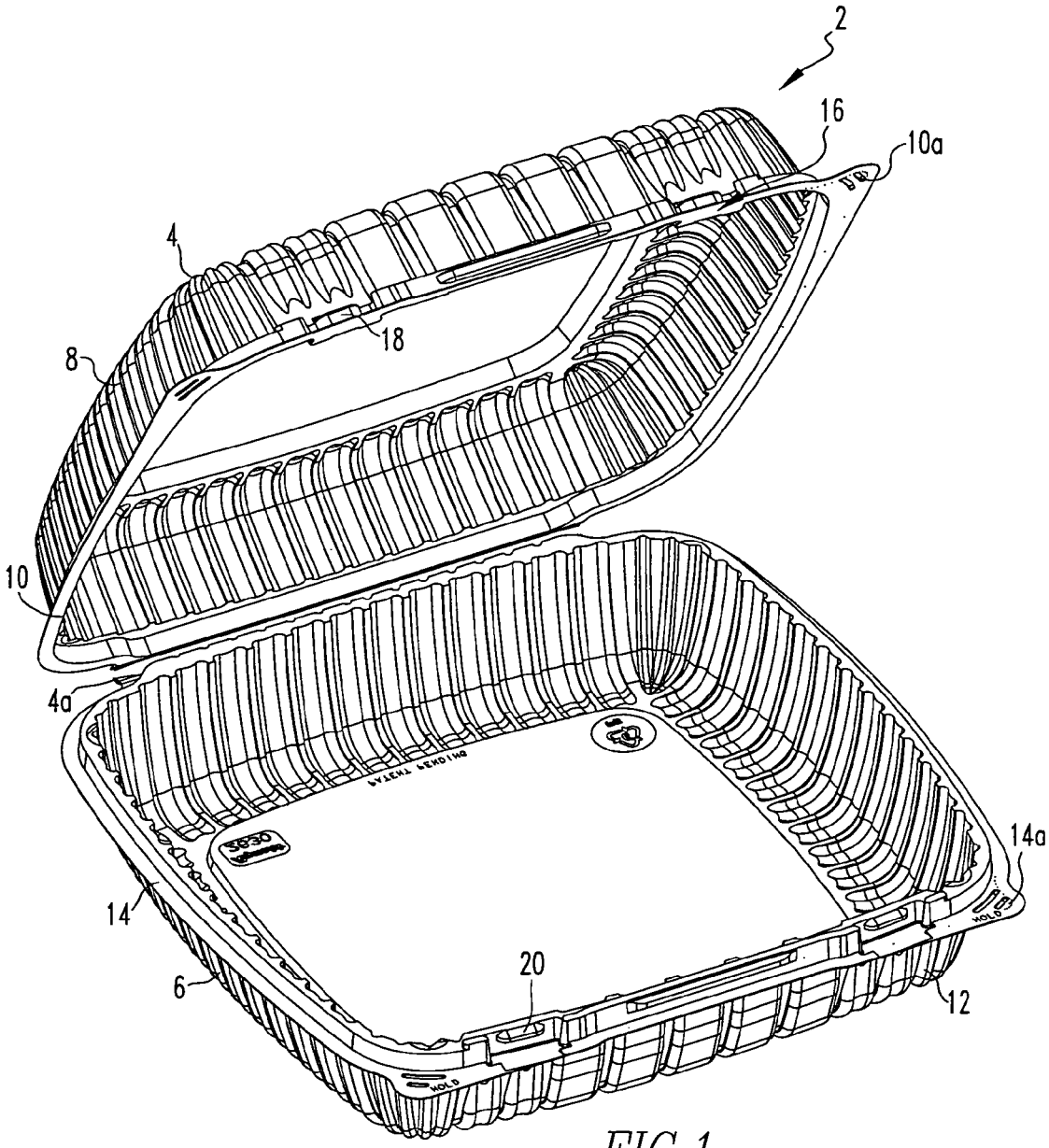
FIG. 1 is a perspective view of a container for food or other articles embodying the present invention showing a lid hinged to a base and locking means for locking the lid to the base.
Figure 2:
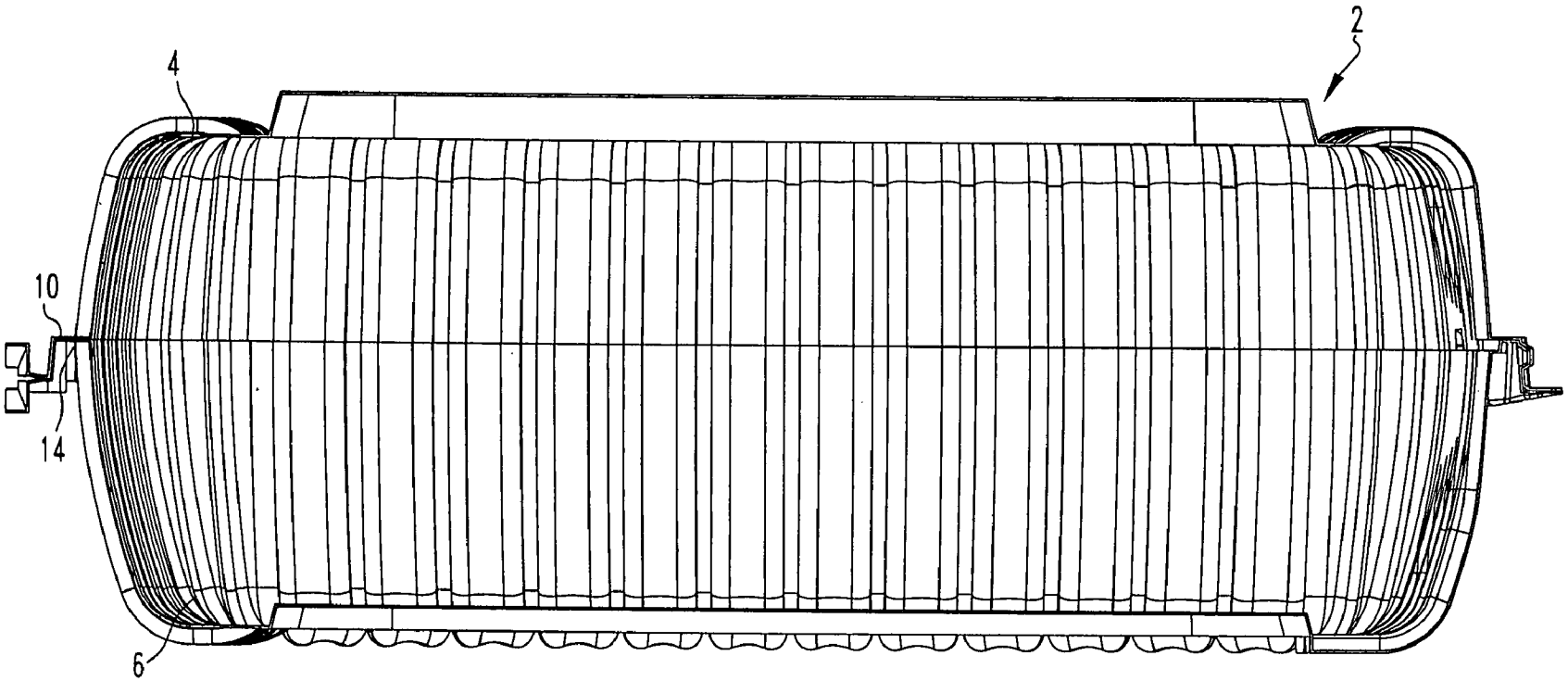
FIG. 2 is a perspective view of the container of the present invention in closed position.
Figure 2A:
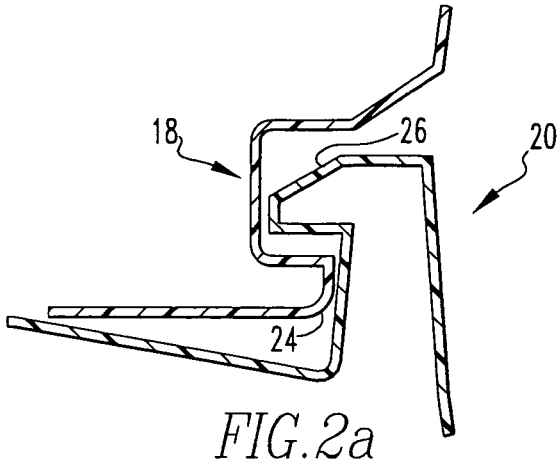
FIG. 2*a* is a cross-sectional view of the locking means showing the detent and the tab interlocked with each other.

Shown in FIG. 1 is a plastic container 2 embodying the present invention. The container 2 is designed to be thermoformed from a suitable plastic material. The preferred plastic material is oriented polystyrene (OPS), but other plastic material such as polyethylene terephthalate (PET) could be used. The container 2 is particularly adapted for food and other articles and includes a lid 4 hinged at the rear 4*a* to a base 6. The lid 4 includes a central dome portion 8 having a horizontal flange 10 extending around the periphery thereof. The base 6 includes a central receptacle portion 12 having a horizontal flange 14 extending around the periphery thereof. The flange 10 on the lid 4 is provided with two independent rims 16, both of which are situated at the front of the lid 4 opposite the hinge 4*a*. The front of the lid 4 is adapted for engagement with the front of the base 6 when the container is in closed condition as shown in FIGS. 2 and 2*a*. The lid and base flanges 10, 14 preferably are provided with extensions 10*a*, 14*a* at the corners adjacent the locking means to aid in opening the container 2.

Figure 3:
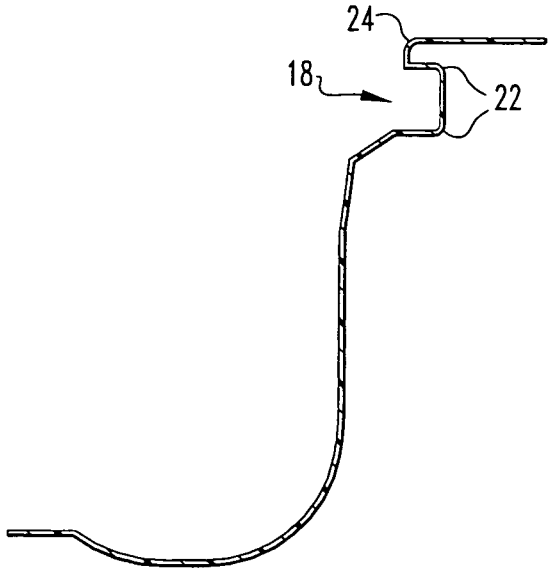
FIG. 3 is a cross-sectional view of the detent that depends from the front of the lid.
Figure 4:
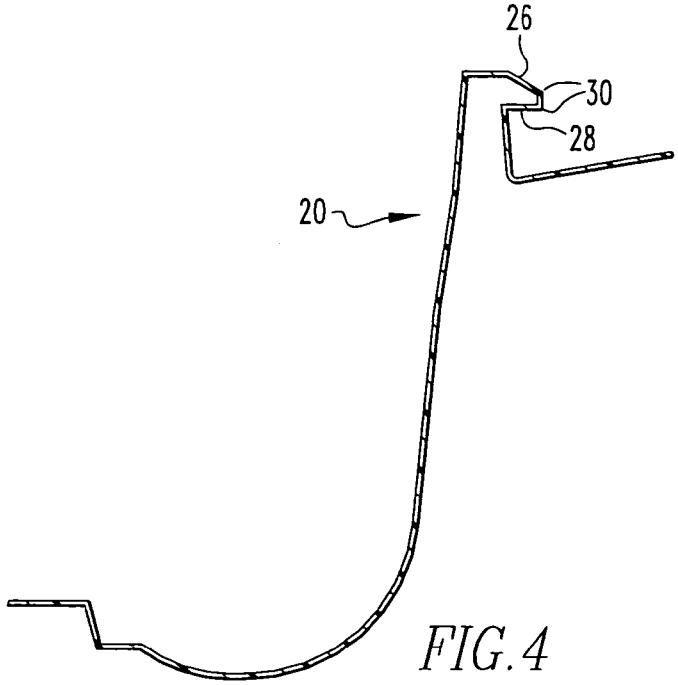
FIG. 4 is a cross-sectional view of the tab that extends from the front of the base.

The container 2 shown in FIG. 1 is provided with locking means for locking the lid 4 to the base 6. The locking means comprises locking structures having male and female locking elements containing hook structures, specifically a detent 18 and a tab 20, that interlock with respect to each other when the container is in a closed condition. At least one detent 18 (FIGS. 1 and 3) depends from the central dome structure 8 at the front of the lid 4. At least one tab 20 (FIGS. 1 and 4) depends from the central receptacle portion 12 at the front of the base 6. The detent 18 is dimensioned slightly larger than the tab 20 so as to receive the tab 20 therein (FIG. 2*a*). As may be seen in FIG. 3, the detent 18 has rounded ends 22 and an inwardly extending lip 24 disposed on its outer side. As may be seen in FIG. 4, the tab 20 has an upper surface 26, a lower surface 28, and two end surfaces 30. The upper surface 26 is angled toward the lower surface 28 with the two end surfaces 30 being substantially flat.

When the lid 4 of the container 2 moves from the open condition in FIG. 1 to the closed condition in FIG. 2, FIG.

2*a* shows that the inwardly extending lip 24 of the detent 18 and the upper surface 26 of the tab 20 deflect with respect to each other so that when the detent 18 is pressed into the tab 20, the inwardly extending lip 24 snaps into position beneath the upper surface 26 and interlocks therewith to lock the lid 4 and the base 6. When the container 2 and the locking means are in closed condition as shown in FIGS. 2 and 2*a*, the horizontal flange 10 on the lid 4 will be in engagement with the horizontal flange 14 of the base 6 and will be held in engagement by the locking means described above.

Having described the presently preferred embodiments, it is to be understood that the invention may be otherwise embodied within the scope of the appended claims.

What is claimed is:

1. A container for food or other articles comprising:

a lid having a horizontal flange extending around the periphery thereof, a base having a horizontal flange extending around the periphery thereof and adapted for engagement with the horizontal flange of said lid when said container is in closed condition, means for locking said lid to said base, said locking means comprising:

at least one hook structured detent depending from the front of said lid, said hook structured detent comprising:

an inwardly extending lip, said inwardly extending lip comprising a rounded surface;

a first flat surface, wherein the first flat surface is operably connected to the inwardly extending lip, and wherein the first flat surface is substantially outwardly extending;

a first end, wherein the first end is operably connected to the first flat surface;

a second flat surface, wherein the second flat surface is operably connected to the first end, and wherein the second flat surface is substantially perpendicular to the first flat surface;

a second end; wherein the second end is operably connected to the second flat surface; and, a third flat surface, wherein the third flat surface is operably connected to the second end, and wherein the third flat surface is substantially parallel to the first flat surface; and, at least one hook structured tab in the front of said base dimensioned to engage said hook structured detent in said lid, said hook structured tab comprising:

a first upper surface, wherein said first upper surface extends outwardly;

second upper surface, wherein said second upper surface comprises a flat angled surface, wherein said flat angled surface is disposed at an angle of less than 90 degrees relative to the upper surface;

a first end surface, wherein the first end surface is operably connected to the second upper surface;

a fourth flat surface, wherein the fourth flat surface is operably connected to the second upper surface, and wherein the fourth flat surface is substantially perpendicular to the first upper surface;

a second end surface, wherein the second end surface is operably connected to the fourth flat surface; and, a lower surface, wherein said lower surface is operably connected to the second end surface, and wherein said lower surface is substantially parallel to the first upper surface and wherein said inwardly extending lip of said hook structured detent and said flat angled surface of said hook structured tab are constructed such that when said hook structured detent engages said hook structured tab they deflect with respect to each other whereby said inwardly extending lip will snap into position beneath said lower surface and whereby said hook structured detent and said hook structured tab interlock with respect to each other, thereby interposing the first flat surface and the lower surface on top of each other, such that the first flat surface and the lower surface are horizontally parallel to each other, thereby locking said lid to said base.

2. A container according to claim 1 wherein said lid is hinged to the rear of said base for movement towards and away from said base for opening and closing of said container and said locking means is located at the front of said base.

3. A container according to claim 1 wherein said lid includes a central dome structure extending upwardly from said horizontal flange extending around the periphery thereof and said base includes a central receptacle structure depending from said horizontal flange extending around the periphery thereof.

4. A container according to claim 1 wherein said first end and said second ends of said hook structured detent are rounded.

5. A container for food or other articles comprising a lid having a horizontal flange extending around the periphery thereof and a base having a horizontal flange around the periphery thereof and adapted for engagement with the horizontal flange of said lid when said container is in closed condition, said container comprising means for locking said lid to said base, said locking means comprising:

at least one hook structured detent depending from the front of said lid, said hook structured detent comprising an inwardly extending lip, said inwardly extending lip comprising a rounded surface; a first flat surface, wherein the first flat surface is operably connected to the inwardly extending lip, and wherein the first flat surface is substantially outwardly extending; a first end, wherein the first end is rounded, and wherein the first end is operably connected to the first flat surface; a second flat surface, wherein the second flat surface is operably connected to the first end, and wherein the second flat surface is substantially perpendicular to the first flat surface; a second end, wherein the second end is rounded, and wherein the second end is operably connected to the second flat surface; and, a third flat surface, wherein the third flat surface is operably connected to the second end, and wherein the third flat surface is substantially parallel to the first flat surface; and, at least one hook structured tab in the front of said base dimensioned to engage said hook structured detent in said lid, said hook structured tab comprising a first upper surface, wherein said first upper surface extends outwardly; second upper surface, wherein said second upper surface comprises a flat angled surface, wherein said angled flat surface is disposed at an angle of less than 90 degrees relative to the upper surface; a first end surface, wherein the first end surface is operably connected to the second upper surface; a fourth flat surface, wherein the fourth flat surface is operably connected to the second upper surface, and wherein the fourth flat surface is substantially perpendicular to the first upper surface; a second end surface, wherein the second end surface is operably connected to the fourth flat surface;

and, a lower surface, wherein said lower surface is operably connected to the second end, and wherein said lower surface is substantially parallel to the first upper surface, and wherein said inwardly extending lip of said hook structured detent and said flat angled surface of said hook structured tab are constructed such that when said hook structured detent engages said hook structured tab they deflect with respect to each other whereby said inwardly extending lip will snap into position beneath said lower surface and whereby said hook structured detent and said hook structured tab interlock with respect to each other, thereby interposing the first flat surface and the lower surface on top of each other, such that the first flat surface and the lower surface are horizontally parallel to each other, thereby locking said lid to said base.

6. A container according to claim 5 wherein said lid is hinged to the rear of said base for movement towards and away from said base for opening and closing of said container and said locking means is located at the front of said base.

7. A container according to claim 5 wherein said lid includes a central dome structure extending upwardly from said horizontal flange extending around the periphery thereof and said base includes a central receptacle structure depending from said horizontal flange extending around the periphery thereof.

8. A container according to claim 1 further comprising extensions adjacent to the means for locking to aid in opening the container.

9. A container according to claim 5 further comprising extensions adjacent to the means for locking to aid in opening the container.

10. A container according to claim 1 wherein the container is constructed of oriented polystyrene (OPS).

11. A container according to claim 5 wherein the container is constructed of oriented polystyrene (OPS).

12. A container according to claim 1 wherein the container is constructed of polyethylene terephthalate (PET).

13. A container according to claim 5 wherein the container is constructed of polyethylene terephthalate (PET).

* * * * *